United States Patent [19]

Lind

[11] Patent Number: 5,051,119

[45] Date of Patent: Sep. 24, 1991

[54] RAPPING MECHANISM FOR PRECIPITATOR ELECTRODES

[75] Inventor: Leif Lind, Copenhagen, Denmark

[73] Assignee: FLS miljo a/s, Denmark

[21] Appl. No.: 514,089

[22] Filed: Apr. 25, 1990

[30] Foreign Application Priority Data

May 8, 1989 [GB] United Kingdom ..... 8910542

[51] Int. Cl.[5] ..... B03C 3/76

[52] U.S. Cl. ..... 55/112; 173/94

[58] Field of Search ..... 55/112, 108, 12, 13; 173/90, 94, 102, 115

[56] References Cited

U.S. PATENT DOCUMENTS 3,219,130 11/1965 Stevernagel et al. ..... 173/102
3,435,594 4/1969 Stevernagel ..... 55/112
3,483,669 12/1969 Glaeser et al. ..... 55/112
3,844,742 10/1974 Petersen ..... 55/112
4,526,591 7/1985 Getzin ..... 55/112

FOREIGN PATENT DOCUMENTS 705206 3/1965 Canada ..... 55/112

*Primary Examiner*—Richard L. Chiesa
*Attorney, Agent, or Firm*—Brumbaugh, Graves, Donohue & Raymond

[57] ABSTRACT

A rapping mechanism is provided for rapping a row of electrodes (1) in an electrostatic precipitator. The electrodes (1) consists of vertical strip plates suspended from their upper ends and the mechanism comprises a horizontal rapping bar (3) connected with the lower end of each electrode (1) in the row and a hammer (4) for striking the bar (3) in its axial direction. The connection between the lower end of each electrode (1) and the rapping bar (3) is an elastic connection (8) configured with a predetermined elasticity.

8 Claims, 5 Drawing Sheets

RAPPING MECHANISM FOR PRECIPITATOR ELECTRODES

BACKGROUND OF THE INVENTION

This invention relates to a rapping mechanism for rapping a row of electrodes in an electrostatic precipitator. Such electrodes consist of vertical strip plates suspended from their upper ends, and the rapping mechanism comprises a horizontal rapping bar connecting with the lower end of each electrode in the row and a hammer for striking the bar in its axial direction.

A rapping mechanism of the above kind is known from US-A-3844742. The mechanism is utilised for shaking or vibration of the collecting electrodes in an electrostatic precipitator at regular intervals in order to remove dust deposited on the electrodes and resulting from flue gases passed through the electrostatic precipitator which is used for removal of dust particles. Such a mechanism will hereinafter be referred to as "of the above kind".

As illustrated in the accompanying FIGS. 1, 2 and 3, the connection between the lower ends of the electrodes and the rapping mechanism can, in known manner, be such that the rapping bar is fastened to the electrodes with bolts, that the rapping bar acts upon the electrodes through tongues welded to the lower end of the electrodes, or that the rapping bar acts directly on an edge of the electrodes.

However, in the first two examples mentioned above the effect of the peak force on the electrodes and the energy transmitted to the electrodes will be very heterogenous, i.e. strongly decreasing from the first electrode, at the end of rapping bar subjected to impact from the hammer, to the last electrode in the row. The row may often comprise more than ten electrodes.

In the third example, in which the rapping bar acts upon an edge of each electrode, substantially a bent edge of the electrode, the peak force as well as the energy transmission is substantially uniform for all of the electrodes, but is often inadequate for attaining satisfactory rapping of the electrodes. In any event, a requisite adequately defined and desired impact is not attained since the plate thickness of the electrode and the shape of a possible bend of the electrode edge are determined by factors other than the required transmission of rapping impact to the electrodes.

BRIEF SUMMARY OF INVENTION

An object of the invention is to overcome the above-mentioned drawbacks and according to the invention this is achieved by a rapping mechanism of the above kind, characterised in that the connection between the lower end of each electrode and the rapping bar is an elastic connection configured with a predetermined elasticity.

Due to the elasticity of the connection, all electrodes in an electrode row are subjected to a more uniform influence from the rapping bar and, due to the stringently defined elasticity, the electrodes will be subjected to an adequate and desired influence for attaining a required efficiency of dust removal.

The elastic connection may, advantageously, comprise a tongue mounted on the lower end of the electrode whereby the predetermined or desired elasticity is obtainable by means of a specially designed shape of the tongue.

The tongue may consist of a plate having a V-shaped bend at the contact point with an anvil mounted on the rapping bar. The V-shape will then function as a leaf spring and the desired elasticity can be determined based on the appropriate selection of the plate thickness and the V-shape of the tongue.

The tongue may also consist of a plate having a double V-shaped bend at the contact point with an anvil mounted on the rapping bar.

The rapping bar may comprise two pieces of flat iron/steel interconnected by means of intermediate anvils for actuating the tongues on the electrodes, and the two pieces of flat iron may simultaneously constitute a lower guide for the electrodes. With the electrodes suspended from their upper ends only, the double V-shape will appropriately be capable of guiding the free lower ends of the electrodes between the two flat, irons of the rapping bar.

BRIEF DESCRIPTION OF DRAWINGS

The invention will now be described in further details with reference to the accompanying drawings, in which.

DESCRIPTION OF THE PREFERRED EMBODIMENTS

Figure 1:
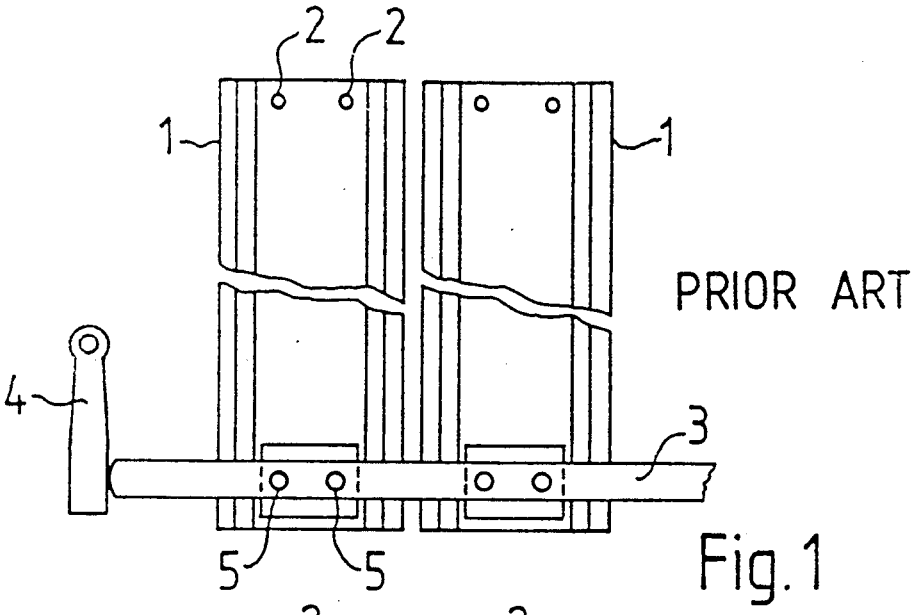
FIGS. 1, 2 and 3 show examples of known rapping mechanisms.
Figure 2:
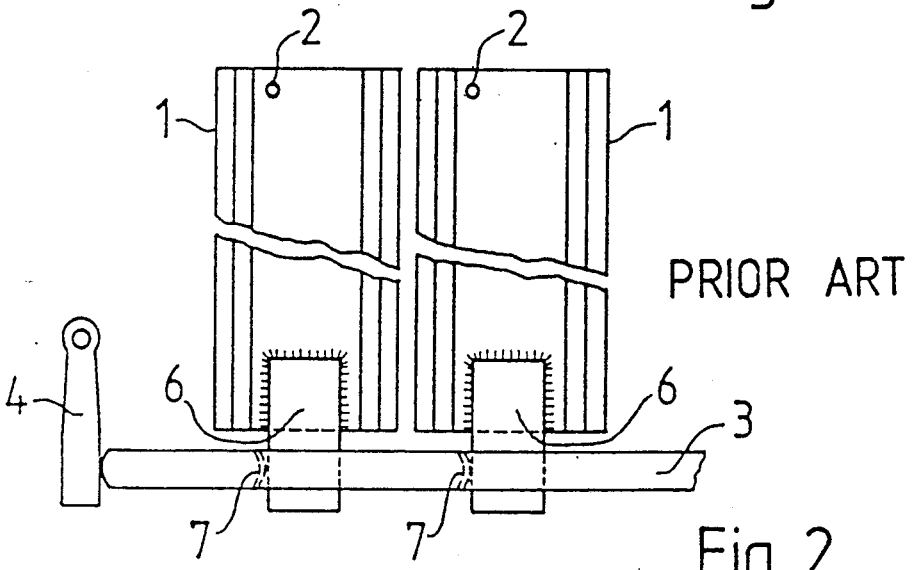
Figure 3:
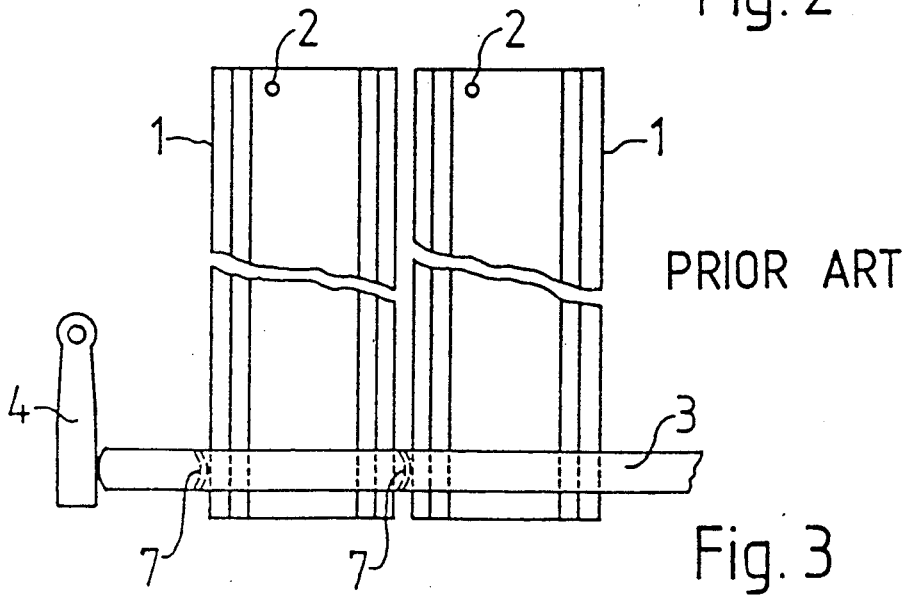

In the known examples in FIGS. 1, 2 and 3 the collecting electrodes are suspended from their upper ends in a row, one after the other, as indicated by means of holes 2. The free lower ends of the electrodes 1 are connected to a common rapping bar 3 arranged so that one of its ends is subjected to impact force from a hammer 4.

In FIG. 1 the rapping bar is shown fastened to the electrodes by means of bolts 5. In FIG. 2 the lower ends of the electrodes are provided with tongues 6 welded to the electrodes and influenced by the rapping bar 3 through anvils 7 mounted on the rapping bar. The tongues are omitted in FIG. 3 and the anvils 7 of the rapping bar 3 are instead in close contact directly with one of the edges of each of the electrodes 1.

In FIGS. 2 and 3 the electrodes are eccentrically suspended, as indicated by a single suspension point 2 for each electrode, so that the electrodes (FIG. 3) or their tongues (FIG. 2) are continually in contact with the anvils 7 of the rapping bar 3.

Figure 4:
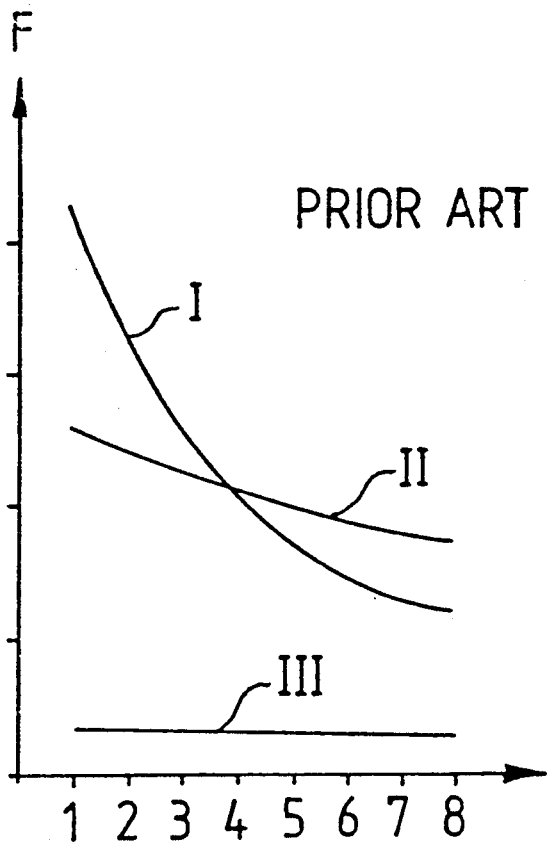
FIGS. 4 and 5 show forces and energy transmitted to the electrodes by means of the above-mentioned mechanisms.

FIG. 4 shows the peak force transmitted to the single electrode in an electrode row consisting of eight electrodes, and the curve I corresponds to the mechanism as shown in FIG. 1, the curve II to a mechanism as shown in FIG. 2, and the curve III to the mechanism as shown in FIG. 3. In similar manner the energy transmitted to the single electrode is shown in FIG. 5.

Figure 5:
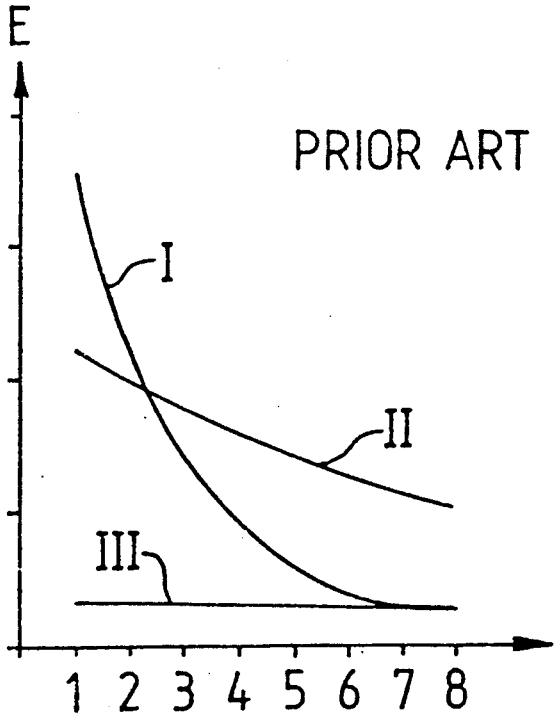

As is apparent from FIGS. 4 and 5, the force as well as the energy transmitted decreases from the first electrode to the last electrode in a row, both for the mechanism shown in FIG. 1 and that in FIG. 2, whereas a more uniform force and energy are transmitted by a mechanism as shown in FIG. 3. However, as indicated in FIGS. 4 and 5, the latter force and energy transmitted by a mechanism according to FIG. 3 is rather feeble, being partly due to the fact that the electrode is fabricated from a relatively thin material and partly due to the fact that the shape of the bent edge of the electrode is chosen according to factors other than the transmission of force and energy.

Figure 6:
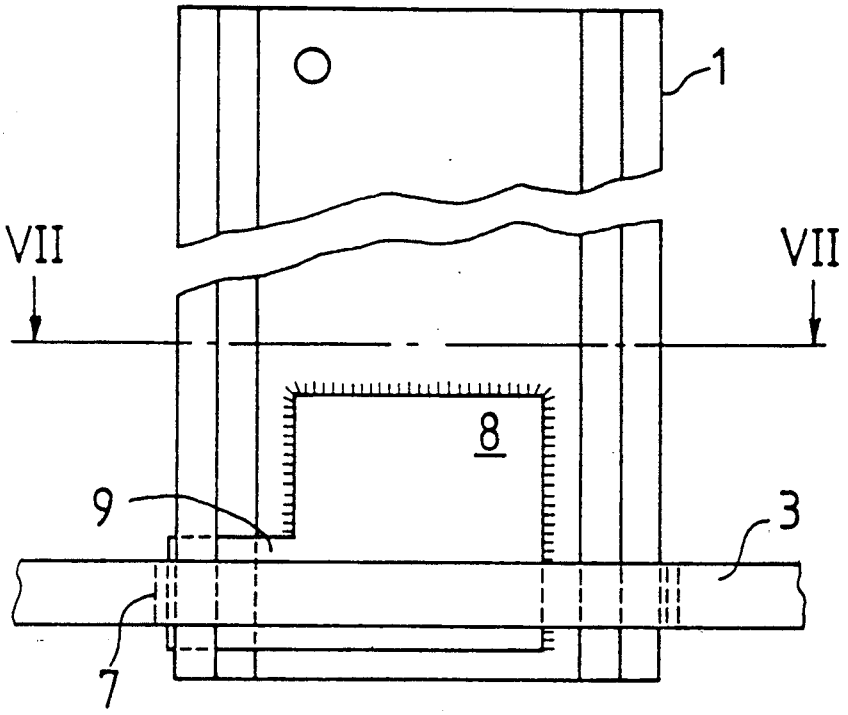
FIG. 6 shows a first example of a rapping mechanism according to the present invention.
Figure 7:
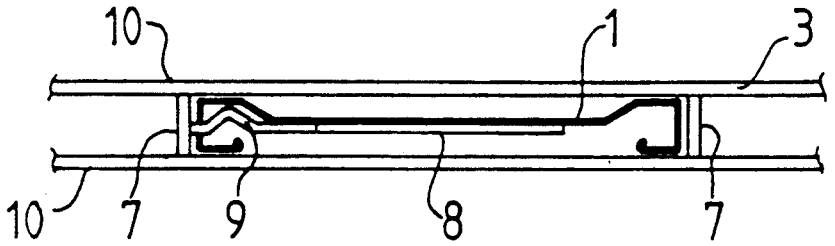
FIG. 7 shows a section along the line VII—VII in FIG. 6.

FIGS. 6 and 7 show a first example of a rapping mechanism according to the invention, comprising, at the lower end of an electrode 1, a tongue or plate 8 welded to the electrode and having a projecting V-shaped part in close contact with an anvil 7, mounted on the rapping bar 3. The V-shaped bend projects through a slot in the bent plate edge of the electrode 1 for contact with the anvil 7. When influenced by the rapping bar 3 through the anvil 7, the V-shape functions as a leaf spring so as to ensure an elastic transmission of forces to the electrode 1. By an appropriate selection of the V-bend shape and the plate thickness of the tongue 8, a predetermined and desired elasticity can be obtained, such elasticity being capable of providing a predetermined transmission of force and energy to the electrode.

As is apparent from FIG. 7, the rapping bar 3 consists of two pieces of flat iron 10 attached to one another by means of the anvils 7.

Figure 8:
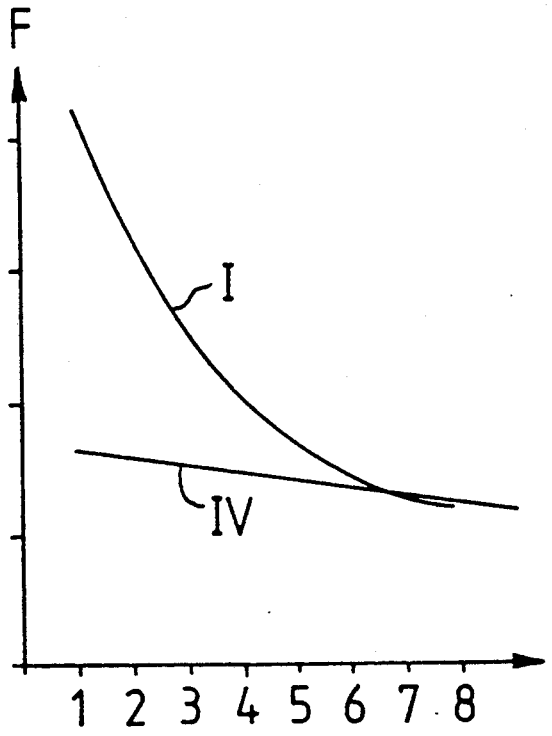
FIGS. 8 and 9 show comparison curves for the transmission of forces and energy by the rapping mechanism in FIG. 1 and a rapping mechanism according to the invention, respectively.
Figure 9:
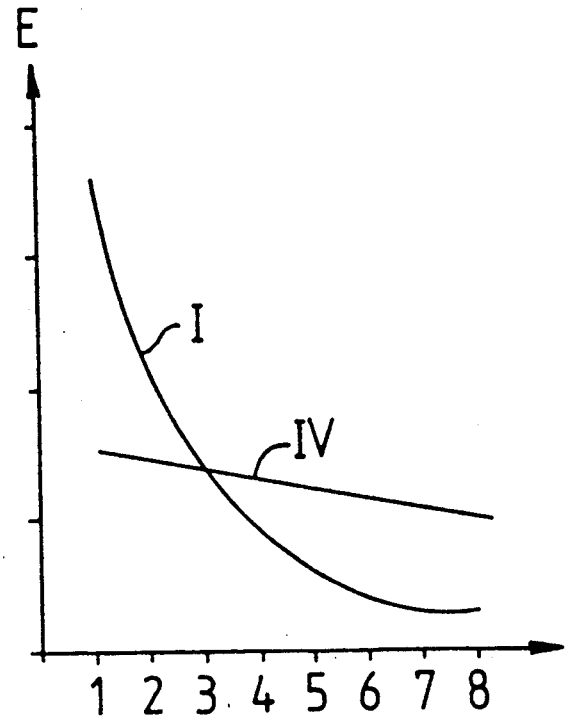

FIGS. 8 and 9 show curves corresponding to FIG. 4 and FIG. 5, respectively. The curves I show the forces and energy transmitted to the various electrodes by means of the known rapping mechanism in FIG. 1, whereas the curves IV show the forces and energy transmitted to the various electrodes by means of the rapping mechanism according to the invention and shown in FIGS. 6 and 7.

As will be seen, a relatively uniform transmission of forces and energy is obtained by means of the rapping mechanism according to the invention (curve IV) and, as mentioned previously, a sufficient and predetermined impact force and energy transmission, i.e. a desirable location of the curves IV in the two diagrams shown in FIG. 8 and 9, can be obtained by an appropriate selection of the V-shape and the plate thickness of the tongue 8, independently of the plate thickness and the shape of edge of the electrode 1.

Figure 10:
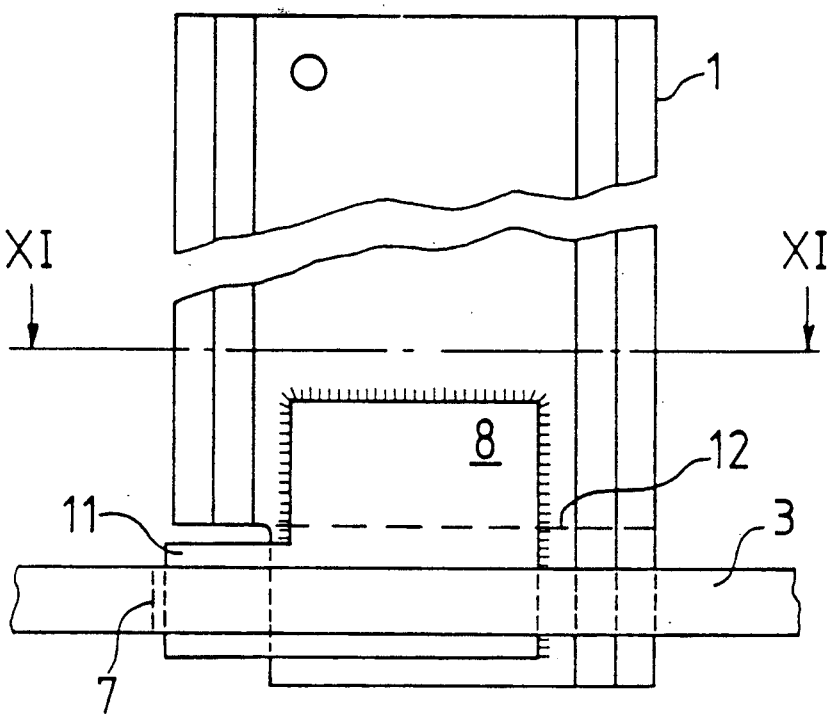
FIG. 10 shows another example of a rapping mechanism according to the present invention; and, FIG. 11 shows a section along the line XI—XI in FIG. 10.
Figure 11:
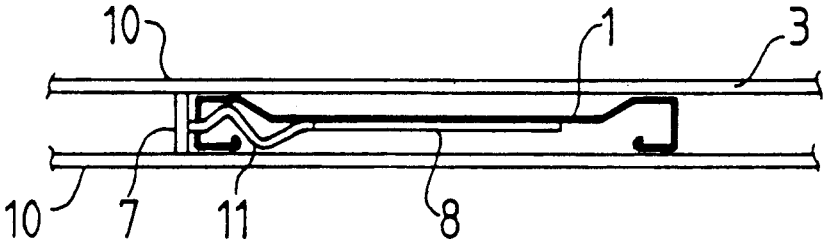

In FIGS. 10 and 11 is shown a second example of a rapping mechanism according to the invention and this example differs from that illustrated in FIGS. 6 and 7 in that the projecting V-shaped member 9 of the tongue 8 is provided with a double V-shape and in that the electrode edge is cut away at the level with the V-shaped member 9.

In this example, the rapping bar 3 is also made of two pieces of flat iron interconnected by means of the anvils 7 so that, in conjunction with the double V-shape member of the tongue 8, the rapping bar can form a guide for the otherwise free-hanging lower end of the electrode 1. Consequently, the outlined configuration of rapping bar and tongue will also be advantageous in that the lower end of the electrode 1 is cut away as indicated by a dotted line 12 in FIG. 10, the tongue having a guiding V-shaped member on its other side as well.

In the examples shown in FIGS. 6 and 7 and FIGS. 10 and 11 respectively, the tongue on each electrode consists of a rectangular plate fixed by welding to the lower end of the electrode, such plate preferably having a thickness of 4–8 mm and a width and a height consituting 50%–80% of the electrode width. In the examples shown, the V-shaped member 9 or 11 of the rectangular plate 8 is configured as a projecting part of the plate and may advantageously have a length of 10–80 mm and a total bend height of the V-shape of 10–30 mm.

I claim:

1. A rapping mechanism for rapping a row of electrodes in an electrostatic precipitator, said precipitator having support means for said electrodes, said electrodes consisting of vertical strip plates and being suspended at their upper ends from said support means, said mechanism comprising:

a horizontal rapping bar;

a hammer for striking the bar in its axial direction; and, connection means connecting said rapping bar with the lower end of each electrode in the row, said connection means being an elastic connection configured with a predetermined elasticity in the horizontal direction corresponding to said horizontal rapping bar.

2. A rapping mechanism according to claim 1, wherein said elastic connection means comprises a tongue mounted on the lower end of each electrode.

3. A rapping mechanism according to claim 2, wherein said rapping bar has a plurality of anvils corresponding in number to said electrodes, said tongue consisting of a plate and said plate having a double V-shaped bend at the contact point with a respective said anvil.

4. A rapping mechanism according to claim 2, wherein said rapping bar comprises two pieces of flat iron and a plurality of anvils for actuating the tongues on said electrodes, said two pieces of flat iron being interconnected by said plurality of anvils, said two pieces of iron further comprising a lower guide for said electrodes via the tongues.

5. A rapping mechanism according to claim 2, wherein said tongue on each electrode comprises a rectangular plate attached to said electrode, said plate having a thickness of 4–8 mm and a width and a height comprising 50%–80% of the electrode width, said plate having a V-shaped part, said V-shaped part comprising a projecting part of the plate and having a length of a 10–80 mm and a total height of the V-shaped part of 10–30 mm.

6. A rapping mechanism according to claim 2, wherein said rapping bar has a plurality of anvils corresponding in number to said electrodes, said tongue consisting of a plate and said plate having a V-shaped bend capable of elastic compression when the rapping bar is struck with the hammer.

7. A rapping mechanism according to claim 6, wherein said V-shaped bend is located at the contact point between said plate and a respective said anvil.

8. An electrostatic dust precipitator having a plurality of dust collecting electrodes provided with a rapping mechanism for cleaning a row of said electrodes; and support means, said electrodes being suspended at their upper ends from said support means, said rapping mechanism comprising:

a horizontal rapping bar;

a hammer for striking the bar in its axial direction; and, connection means connecting said rapping bar with the lower end of each electrode in the row, said connection means being an elastic connection configured with a predetermined elasticity in the horizontal direction corresponding to said horizontal rapping bar.

* * * * *